US005136912A

United States Patent [19]

Morikawa et al.

[11] Patent Number: 5,136,912

[45] Date of Patent: * Aug. 11, 1992

[54] ELECTRONIC TONE GENERATION APPARATUS FOR MODIFYING EXTERNALLY INPUT SOUND

[75] Inventors: Shigenori Morikawa; Kohtaro Hanzawa; Kazuhisa Nakamura, all of Tokyo, Japan

[73] Assignee: Casio Computer Co., Ltd., Tokyo, Japan

[ * ] Notice: The portion of the term of this patent subsequent to Jun. 25, 2008 has been disclaimed.

[21] Appl. No.: 663,729

[22] Filed: Mar. 1, 1991

Related U.S. Application Data

[60] Division of Ser. No. 456,617, Dec. 22, 1989, Pat. No. 5,025,700, which is a continuation of Ser. No. 336,524, Apr. 10, 1989, abandoned, which is a continuation of Ser. No. 162,637, Mar. 1, 1988, abandoned, which is a division of Ser. No. 902,530, Sep. 2, 1986, Pat. No. 4,754,680.

[30] Foreign Application Priority Data

Sep. 10, 1985 [JP] Japan ..... 60-200259
Sep. 11, 1985 [JP] Japan ..... 60-201301

[51] Int. Cl.[5] ..... G10H 1/12; G10H 7/02

[52] U.S. Cl. ..... 84/603; 84/604; 84/622

[58] Field of Search ..... 84/602-607, 84/622-633, DIG. 9, DIG. 10; 364/419, 724.01-724.2; 341/110, 122, 126

[56] References Cited

U.S. PATENT DOCUMENTS 4,195,544 4/1980 Koike .
4,305,319 12/1981 Linn .
4,351,218 9/1982 Deutsch .
4,383,462 5/1983 Nagai et al. .
4,422,156 12/1983 Sano .
4,442,745 4/1984 Gross .
4,461,199 7/1984 Hiyoshi et al. .
4,472,993 8/1984 Futamase et al. .
4,479,411 10/1984 Ishibashi et al. .
4,502,361 3/1985 Vitanen .
4,539,884 9/1985 Aoki .
4,622,877 11/1986 Strong .
4,785,707 11/1988 Suzuki .

FOREIGN PATENT DOCUMENTS 0122634 10/1984 European Pat. Off. .
0124197 11/1984 European Pat. Off. .
2553348 8/1976 Fed. Rep. of Germany .
3325658 4/1984 Fed. Rep. of Germany .
51-178219 7/1976 Japan .
54-161313 12/1979 Japan .
55-28072 2/1980 Japan .
55-16698 12/1980 Japan .
61-120093 1/1986 Japan .
2023955 1/1980 United Kingdom .

*Primary Examiner*—Stanley J. Witkowski
*Attorney, Agent, or Firm*—Frishauf, Holtz, Goodman & Woodward

[57] ABSTRACT

A tone generation control unit has four waveform read/write channels for selectively the reading or writing data in a waveform memory. A plurality of waveform signals stored in the waveform memory are converted into analog signals to be subjected to timbre and tone volume control through voltage-controlled filters and voltage-controlled amplifiers before being fed to a mixing adder. An output signal of the mixing adder is converted into a digital signal which is stored in the waveform memory again through processing of the tone generation control unit. The stored converted output from the mixing adder is later used again as a new sound source waveform which is operated on to produce tones.

10 Claims, 5 Drawing Sheets

ELECTRONIC TONE GENERATION APPARATUS FOR MODIFYING EXTERNALLY INPUT SOUND

This is a division of application Ser. No. 07/456,617 filed Dec. 22, 1989 (now U.S. Pat. No. 5,025,700), which is a continuation of Ser. No. 07/336,524 filed Apr. 10, 1989 (abandoned) which is a continuation of Ser. No. 07/162,637 filed Mar. 1, 1988 (abandoned) which is a Division of Ser. No. 902,530, filed Sept. 2, 1986, now U.S. Pat. No. 4,754,680.

BACKGROUND OF THE INVENTION

This invention relates to an electronic tone generation apparatus, such as for use in an electronic musical instrument, in which external acoustic signals are recorded in a digital form, modified, and sounded as a modified sound.

Heretofore, it has been in practice to store externally applied acoustic signals of musical sounds of musical instruments such as piano, violin, etc. or voices of birds in a memory in a digital form through a proper modulation system, e.g., PCM (pulse coded modulation) and read out the stored signals from the memory as tone signals of a keyboard musical instrument.

Copending U.S. patent applications Ser. Nos. 760,290 and 760,291 both filed Jul. 29, 1985 and assigned to the same assignee as this application disclose a musical instrument of such a type as described above. The '290 application issued as U.S. Pat. No. 4,681,008 on Jul. 21, 1987 and the '291 application issued as U.S. Pat. No. 4,667,556 on May 26, 1987.

This type of keyboard musical instrument or apparatus, which is called sampling machine, because of a sampling function, may be designed to have an overdubbing function, i.e., a function of superimposing a plurality of previously recorded acoustic signals to produce a separate tone signal. None of such apparatuses with overdubbing function, however, has yet been put into practice.

SUMMARY OF THE INVENTION

An object of the invention is to provide an electronic tone generation apparatus for receiving and storing a sound, modifying the stored sound signal, and sounding a modified sound.

Another object of the invention is to provide such an apparatus which is simple in construction and operation and provides pleasant performance.

According to an aspect of the invention an electronic tone generation apparatus produces a modified waveform signal which corresponds to a modification of an external input sound signal, and stores the modified waveform signal for future use in generating sound. The apparatus comprises external signal input means for receiving an external analog input signal; sampling means coupled to said external signal input means for receiving said external analog input signal and for sampling said external analog input signal at a predetermined sampling frequency to produce a digital waveform signal; waveform memory means coupled to said sampling means for storing said digital waveform signal provided from said sampling means; signal modifying means coupled to said waveform memory means for reading out a digital waveform signal representing a waveform stored in the waveform memory means, and for modifying a timbre characteristic of said read-out digital waveform signal in a predetermined manner; means for supplying a modified waveform signal, derived form the signal modifying means, to the waveform memory means to store, for a later performance, a digital signal representing said modified waveform signal in the waveform memory means; and reading means coupled to said waveform memory means for reading out, at said later performance, the digital signal representing said modified waveform signal; said signal modifying means including filtering means for filtering the read-out digital waveform signal to change the timbre characteristic of the waveform represented by the digital waveform signal.

According to another aspect of the invention, an electronic tone generation apparatus in which an externally generated waveform signal is recorded in the form of a digital signal in a waveform memory means and the digital signal recorded in the waveform memory means is converted into a tone signal having a pitch, comprises external signal input means for receiving an external analog input signal; means for converting said external analog input signal into a digital signal, and for storing said digital signal in said waveform memory means; control means including a plurality of waveform read channels for reading digital signal stored in said waveform memory means to obtain a plurality of tones simultaneously; signal modifying means coupled to said waveform memory means for reading out a digital signal representing a waveform stored in the waveform memory means, and for modifying a timbre characteristic of said read-out digital signal in a predetermined manner; means for supplying a modified waveform signal, derived from the signal modifying means, to the waveform memory means to store, for a later performance, a digital signal representing said modified waveform signal in the waveform memory means; and reading means coupled to said waveform memory means for reading out, at said later performance, the digital signal representing said modified waveform signal; said signal modifying means including filtering means for filtering the read-out digital signal to change the timbre characteristic of the waveform represented by the digital signal.

According to yet another aspect of the invention, an electronic tone generation apparatus, for producing a modified waveform signal which corresponds to a modification of an external input sound signal, and for storing said modified waveform signal for future use in generating sounds, comprises supplying means for supplying a digital waveform signal representing an original sound waveform; waveform memory means coupled to said supplying means for storing said digital waveform signal supplied form said supplying means; signal modifying means coupled to said waveform memory means for reading out a digital waveform signal representing a waveform stored in the waveform memory means, and or modifying at least one characteristic of said read-out digital waveform signal in a predetermined manner; means for supplying a modified waveform signal, derived from the signal modifying means, to the waveform memory means to store, for a later performance, a digital signal representing said modified waveform in the waveform memory means; and reading means coupled to said waveform memory means for reading out, at said later performance, the digital signal representing said modified waveform signal.

BRIEF DESCRIPTION OF THE DRAWINGS

FIGS. 4A to 4F constitute timing charts for explaining the operation of the embodiment;

DETAILED DESCRIPTION OF THE PREFERRED EMBODIMENT

Figure 1:
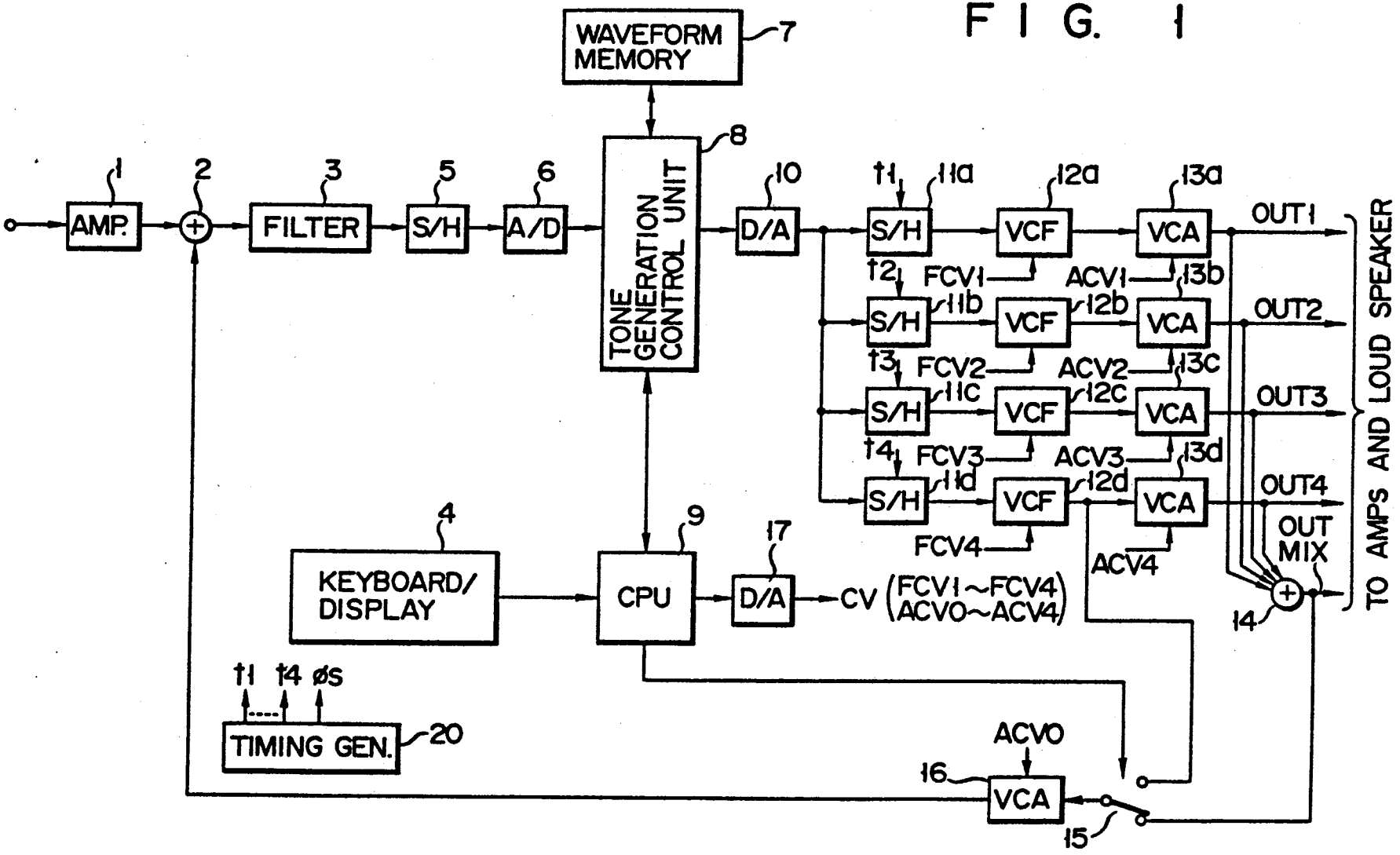
FIG. 1 is a block diagram of an embodiment of the invention.

Now, the invention will be described in conjunction with an embodiment thereof illustrated in the drawings FIG. 1 shows the circuit construction of the embodiment. An input signal IN which is supplied through a microphone or the like, is amplified by an input amplifier 1 and then fed to an analog adder 2. An output signal of analog adder 2 is fed through a filter 3 to a sample/hold (S/H) circuit 5 to be sampled at a proper sampling frequency. An output signal of S/H circuit 5 is fed to an analog-to-digital (A/D) converter 6. A/D converter 6 converts the input analog signal into a corresponding digital signal which is fed to a tone generation control unit 8.

Tone generation control unit 8 has, for example, four waveform read/write channels. These waveform read/write channels can independently access waveform memory 7 to write or read waveform signals. Tone generation control unit 8 may be configured as disclosed in the above-mentioned copending application Ser. No. 760,291 (now U.S. Pat. No. 4,667,556). For a better understanding of this invention, it will be described later in detail with reference to FIG. 3.

Tone generation control unit 8 operates under control of CPU 9 comprised of a microcomputer or the like. Tone generation control unit 8 reads out from wavefrom memory 7 digital signals corresponding to at most four tones on a time-division basis via the four waveform read/write channels, and feed feeds the read out digital signals on a time-division basis to a digital-to-analog (D/A) converter 10. Analog signals of D/A converter 10 are fed to S/H circuits 11*a* to 11*d*.

S/H circuits 11*a* to 11*d* sample corresponding analog signals during respective periods under control of timing signals t1 to t4 generated from a timing generator 20.

S/H circuits 11*a* to 11*d* feed their respective hold voltage signals to voltage controlled filter (VCFs) 12*a* to 12*d*, respectively, VCFs 12*a* to 12*d* filter input signals according to respective voltage signals FCV1 to FCV4.

VCFs 12*a* to 12*d* feed filtered analog waveform signals to voltage controlled amplifiers (VCAs) 13*a* to 13*d*.

VCAs 13*a* to 13*d* have their gain controlled independently according to control voltage signals ACV1 to ACV4 applied thereto to determine the output level or envelope of the waveform signals.

The output signals of VLAas 13*a* to 13*d* are fed as respective channel output signals OUT1 to OUT4 to be suitably amplified and sounded. The output signals of VCAs 13*a* to 13*d* are also mixed in an analog adder 14, an output signal of which may be output as mixed output OUT MIX.

The output signal of VCF 12*d* corresponding to the fourth channel and the output signal of analog adder 14 are fed to an analog switch 15, which is switched under control of CPU 9.

Analog switch 15 thus selects one of the output signal of VCF 12*d* and output signal of analog adder 14 to be applied to VCA 16. VCA 16 amplifies the input signal according to a control voltage signal ACV0 for feedback to analog adder 2.

Thus, an external signal supplied to input amplifier 1 and a waveform signal read out from waveform memory 7 can be mixed in analog adder 2 and then stored again in waveform memory 7.

Reference numeral 4 in the FIG. 1 designates a keyboard having play keys corresponding to respective musical notes and various control switches and a liquid crystal display panel or the like for displaying various states of a musical instrument. The keyboard and display are coupled to CPU 9 for data transmission.

Figure 2:
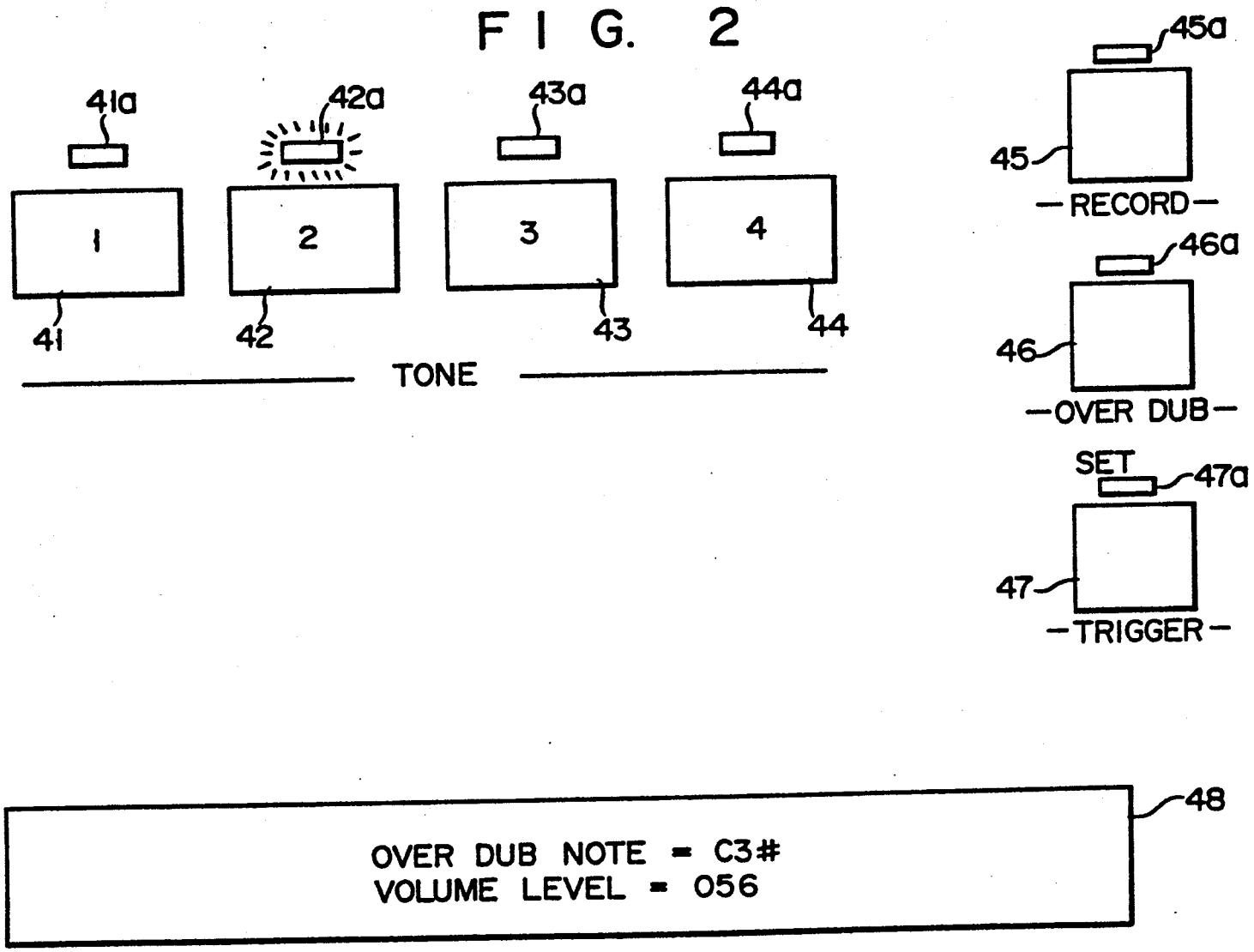
FIG. 2 shows an essential part of a keyboard/display section.

FIG. 2 shows the construction of an essential part of keyboard/display 4. Tone switches 41 to 44 are provided to designate four different tone numbers. Display elements 41*a* to 44*a* consisting of LEDs are provided to display tone numbers designated by tone switches 41 to 44.

Reference numeral 45 in FIG. 2 designates a record switch. Display element 45*a* is lit in response to the operation of record switch 45. Reference numeral 46 designates an overdubbing switch for designating an over-dubbing mode. Display element 46*a* is lit in response to the operation of overdubbing switch 46. Reference numeral 47 designates a trigger switch for providing a trigger signal. Display element 47*a* is lit in response to the operation of trigger switch 47. A procedure of operation of switches 45 to 47 will be described later.

Keyboard/display 4 also has a display 48 consisting of a liquid crystal dot matrix display panel as noted above. Display 48 displays the state of various switches and operation mode in characters. In FIG. 2, an example of display representing a certain state is shown, and the meaning of the display will be described later.

CPU 9 in FIG. 1 is programmed to feed digital signals to D/A converters 17 for providing voltage signals which serve as control signals FCV1 to FCV4, ACV1 to ACV4 and ACV0 noted above (these signals being generally referred to as control signal CV).

D/A converter group 17 may consist of a plurality of D/A converters corresponding in number to the number of control signals CV. Alternatively, a single D/A converter may be used on a time division basis to obtain the control signals CV.

The circuit construction of tone generation control unit 8 will now be described with reference to FIG. 3.

A digital signal representing a waveform from A/D converter 6 is fed through gate 81 to waveform memory 7 and also fed through gate 82 to D/A converter 10. A gate 81 is controlled by a read/write signal $\overline{R/W}$ which is fed from an internal control circuit 80 of tone generation control unit 8 in response to a control command from CPU 9. Gate 81 is enabled or open when a waveform signal is written into waveform memory 7. Gate 81 is disabled or closed when a waveform signal is read out from waveform memory 7. Actually, gate 81 is controlled by a signal $\overline{R/W}$ which is obtained by inverting the read/write signal $\overline{R/W}$.

Gate 82 is supplied with a gate signal GATE which is provided from a gate signal generator 83 responsive to a control signal from control circuit 80. Gate 82 is enabled only when a digital signal supplied through gate 81 is output or a digital signal read out from waveform memory 7 is output.

Figure 3:
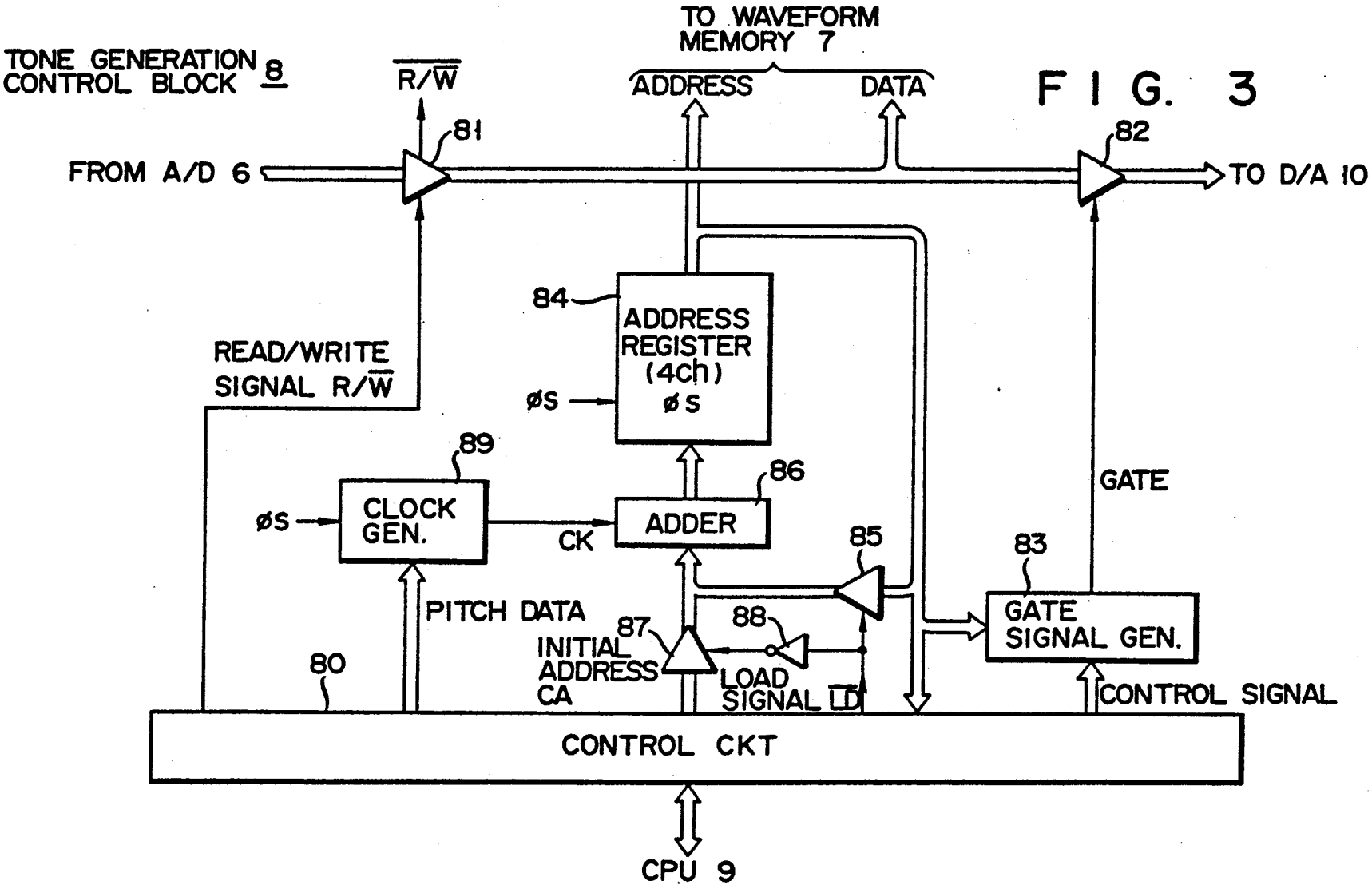
FIG. 3 is a schematic representation of a tone generation control unit.

Reference numeral 84 in FIG. 3 designates an address shift register having four stages (corresponding to the four channels) each consisting of a predetermined number of bits. The shift operation of address register 84 is performed by master clock $\phi_s$ to be described later which is provided from a timing generator 20. Address register 84 operates on a time division basis as a 4-channel address register. Data in its last stage is fed as address data to waveform memory 7. When read/write signal $R/\overline{W}$ is low, a waveform signal fed through gate 81 is written into a memory location designated by the address data. When read/write signal $R/\overline{W}$ is high, a digital signal is read out from the memory location. Data of address register 84 is fed to gate 85, gate signal generator 83 and control circuit 80. The address signal is fed through gate 85 to adder 86, which performs an addition or subtraction operation for address updating. The output of adder 86 is fed back to address register 84. Initial address CA is fed from control circuit 80 through gate 87 to adder 86.

More specifically, a load signal $\overline{LD}$ is fed directly to gate 85, while it is fed through inverter 88 to gate 87. When load signal $\overline{LD}$ is low, initial address CA from control circuit 80 is fed through gate 87 to adder 86. When the load signal is high, on the other hand, gate 85 is enabled, and the data in the last stage of address register 84 is fed to adder 86.

Clock signal CK is fed from clock generator 89 to adder 86. When a digital signal is read out from waveform memory 7 at a tone pitch frequency, a clock signal is fed to adder 86 at a rate corresponding to pitch data from control circuit 80. When digital data is written into waveform memory 7, a clock signal is generated at a rate of the sampling frequency to effect address updating.

Figure 4A:
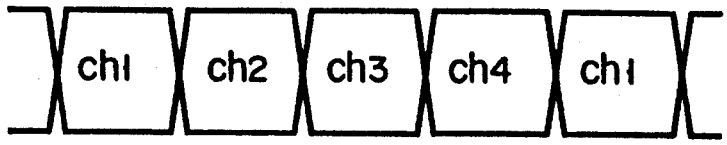
Figure 4B:
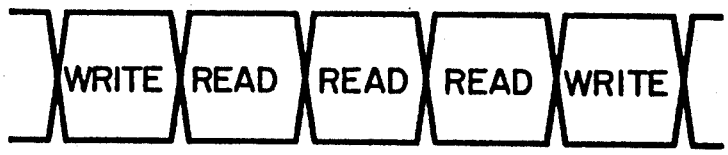
Figure 4B:
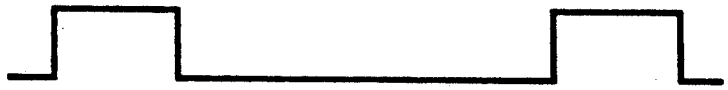
Figure 4B:
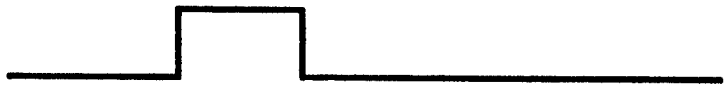
Figure 4B:
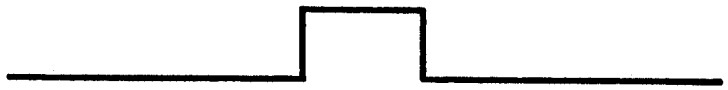
Figure 4B:
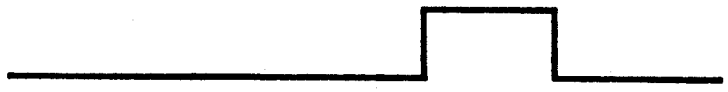

The operation of the embodiment will now described. FIGS. 4A to 4F are timing charts of the time division processing of the individual channels of tone generation control unit 8 and timing signals t1 to t4 fed to S/H circuits 11*a* to 11*d*. As noted above, in this embodiment the four waveform read/write channels are realized by a time division arrangement as depicted in FIG. 4A, and either read operation or write operation is selectively designated independently for each waveform read/write channel. In an example shown in FIG. 4 (B), in case of channel 1 (ch1) a waveform signal obtained through filter 3, S/H circuit 5 and A/D converter 6 is written in waveform memory 7, while in cases of the other channels 2 to 4 (ch2 to ch4) digital waveform signals are read out from predetermined areas of waveform memory 7.

Timing signals t1 to t4 shown in FIG. 4 (C) through (F) go high during periods corresponding to the respective channels (ch1 to ch4). During the respective channel times analog waveform signals provided from D/A converter 10 are sampled and held in S/H circuits 11*a* to 11*d*.

Figure 5:
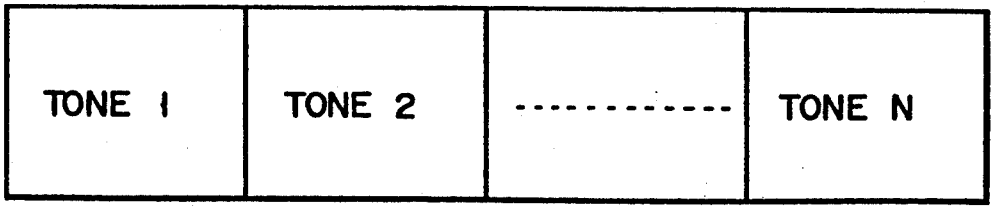
FIG. 5 shows a storage state of a waveform memory.

FIG. 5 shows divided areas of waveform memory 7. For example, N different waveform signals having variable length can be stored. Each waveform read/write channel of tone generation control unit 8 can independently designate a read/write memory area. For example, in the cases of channels 2 to 4, tone data 1 to 3 shown in FIG. 5 are read out to be fed through VCFs 12*b* to 12*d*, VCAs 13*b* to 13*d*, analog adder 14, switch 15 and VC16 to analog adder 2 and then mixed with an external sound signal, if necessary. The output signal of adder 2 is stored in waveform memory 7 as tone data N in accordance with processing of channel 1. It is to be noted that it is possible to effect overdubbing.

Further, it is possible that CPU 9 switches analog switch 15 to apply a waveform signal read out from waveform memory 7, in accordance with the processing of channel 4, through S/H circuit 11*d*, VCF 12*d* and VCA 16 to analog adder 2 for mixing with an external sound signal before being written in a predetermined area of waveform memory 7 in the manner as described above.

Figure 6:
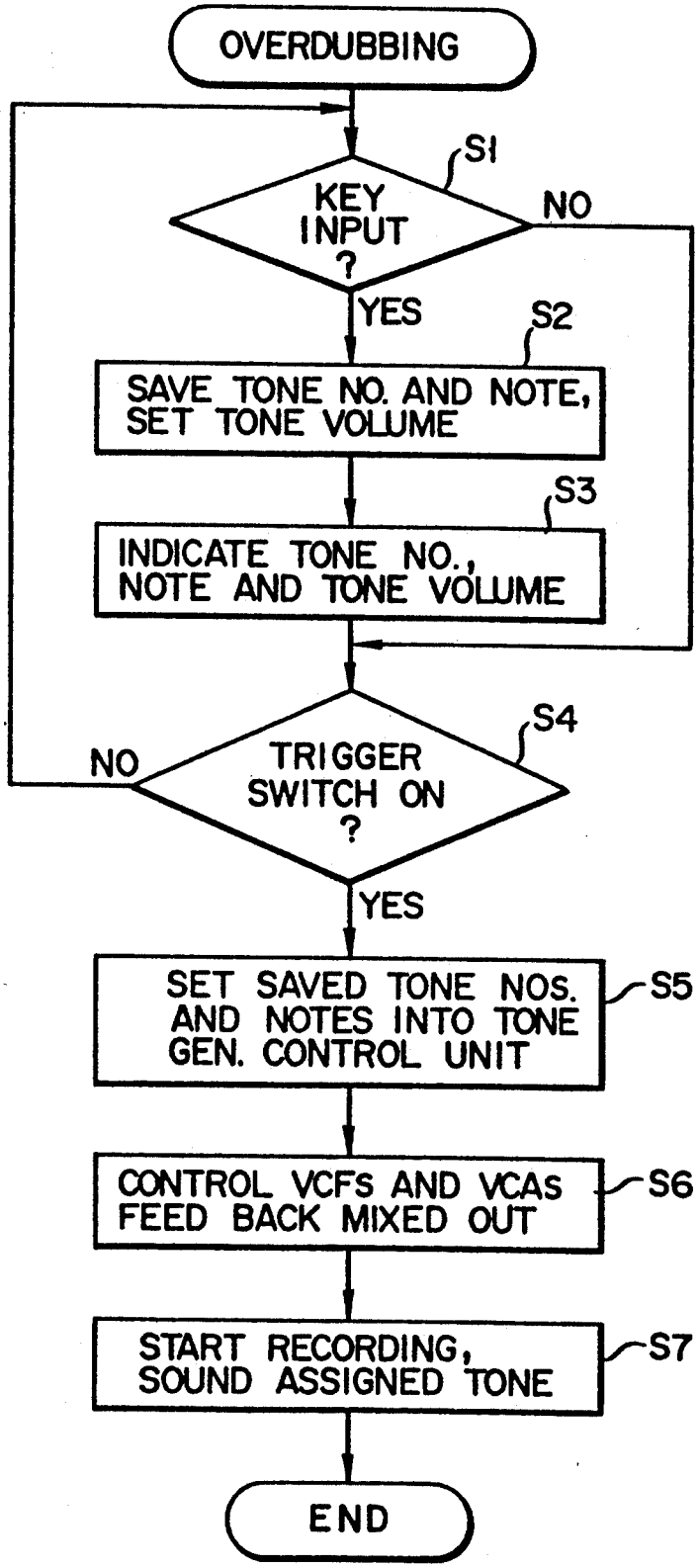
FIG. 6 is a flow chart for explaining the operation of the embodiment.

Now, processing made mainly by CPU 9 in the overdubbing mode will be described in detail with reference to the flow chart of FIG. 6.

The overdubbing mode is designated by overdubbing switch 46 in keyboard/display 4. In step S1, CPU 9 checks as to whether a keyboard operation or switch operation is done in keyboard/display 4 to determine a waveform signal to be read out from waveform memory 7 and a note pitch thereof.

In this embodiment, the pitch of a tone to be generated is designated by a corresponding performance key on the keyboard. The waveform signal stored in waveform memory 7 is read out at a high readout rate when a high tone pitch note is designated while it is read out at a low read out rate when a low tone pitch note is designated. In other words, pitch data applied to clock generator 89 corresponds to the designated note.

In step S1, when it is detected that there is a key input, a decision "Yes" is yielded, and the routine goes to step S2. In step S2, CPU 9 stores the number of tone data to be read out from waveform memory 7 as designated by keyboard/display 4. CPU 9 also stores a note designated by key operation. Further, CPU 9 stores data for determining a corresponding tone volume. The tone volume are set by operating numeral keys and up/down keys provided on keyboard/display 4. The routine then goes to step S3.

For example, tone switch 42 is operated to designate tone 2, and thus display element 42*a* flickers. Then, the key corresponding to note C3# is operated on the keyboard and the tone volume is set to a level of "56" by the tone volume setter.

In step S3, the tone number is indicated by display element 42*a* and the note of C3# and the tone volume level of "56" are visually displayed on display unit 48. FIG. 2 shows such a state as described above on the display panel 48.

The routine then goes to step S4 for checking as to whether trigger switch 47 is on. If trigger switch 47 is not on, the routine goes back to step S1. In case where tone switch 43 designating tone 3 is operated, the key of note C4# is operated on the keyboard, and the tone volume is set to level "50", a similar display is obtained through steps S2 and S3.

At this time, if a different note is designated on the keyboard while designating the same tone number, this state is indicated by display elements 41*a* to 44*a* and display unit 48.

Finally, the stored digital signals and externally supplied signals, if any, are combined to designate a tone number to be set. If tone switch 44 is operated while operating record switch 45, then, in the above example, the sound of tone 2 is reproduced at the pitch of note C3# and tone volume of level "56", and the waveform signals of tones 2 and 3 are synthesized to be recorded as tone 4 in waveform memory 7. At the time of operation of record switch 45 display elements 42*a* and 43*a* are turned on and display element 44*a* is caused to flicker, thus indicating the tone number of the tone being reproduced and the tone number of the tone being recorded.

Step S4 is also executed if the check of step S1 yields "No". In step S4, a check is done as to whether a trigger signal for starting actual recording is supplied from keyboard/display 4. If no trigger signal has been provided yet, the routine goes back to step S1. Subsequently, steps S1 and S4 or steps S1 through S4 are repeatedly executed in a standby state.

When a plurality of keys are operated on the keyboard, up to three different notes can be allotted to channels 2 to 4. When different tone numbers are designated in the individual channels, waveform signals of different timbres are reproduced with the designated notes. When the same tone number is designated in the individual channels, a waveform signal of the same timbre is reproduced with different designated pitches. The reproduced signals are overdubbed with different tone volumes.

If it is detected in step S4 that there is a trigger input from trigger switch 47, the routine goes to step S5. Alternatively, it may be arranged such that when the input signal IN exceeds a predetermined level, a trigger input is given to CPU 9, causing the routine to go to step S5 automatically.

In step S5, CPU 9 feeds the saved tone number and note data to tone generation control unit 8 and designates the area and note of waveform data to be read out from waveform memory 7 in the individual waveform read/write channels.

In subsequent step S6, CPU 9 supplies D/A converter group 17 with digital signals for generating control signals corresponding to the levels set in keyboard/display 4. Thus, voltage control signals CV are generated and applied to VCFs 12*a* to 12*d*, VCAs 13*a* to 13*d* and VCA 16.

Further, CPU 9 feeds a switching signal to analog switch 15 to feed the mixed waveform signal from adder 14 to VCA 16. The routine then goes to step S7, in which CPU 9 starts actual recording using channel 1. At this time, the designated channels among channels 2 to 4 operate to read out waveform data of acoustic signals, which have already been determined, from waveform memory 7.

When the input processing is over, an end state is brought about, whereupon CPU 9 returns to process a main routine (not shown).

As has been shown, with the above embodiment tone generation control unit 8 is provided with four waveform read/write channels for independently reading and writing waveform signals, and the same digital signal or different digital signals are read out from the waveform memory through at least two channels, the read-out digital signal or signals being subjected to independent and tone volume control through VCFa 12*a* to 12*d* and VCAs 13*a* to 13*d*, the output signals of which are mixed to be written as a new tone signal in waveform memory 7 using a particular channel. Thus, it is possible to fulfill the overdubbing function and provide pleasant musical effects.

In addition, waveform data can be read out from waveform memory 7 using at most three of the four waveform read/write channels, and this reproduced waveform data may be combined, if necessary, with input waveform signal IN to produce tone waveform data. Thus, it is possible to provide various forms of overdubbing.

Further, waveform memory 7 can be divided into a plurality of areas, and a waveform signal obtained as a result of overdubbing may be written in an area different from the area where the original waveform signal is recorded. Thus, it is possible to obtain overdubbing without erasing the original waveform signal.

Further, for waveform signals read out from waveform memory 7 through a plurality of waveform read/write channels the tone volume level may be set independently using VCAs 13*a* to 13*d*.

Further the same waveform data may be read out from the same memory area through a plurality of waveform read/write channels at different note pitches, and the resultant data may be combined while varying the mixing ratio through VCAs 13*a* to 13*d*.

Further, in the above embodiment the tone number, note and tone volume are displayed by display elements 41*a* to 44*a* and display unit 48, which promotes the efficiency of the overdubbing process and improves the operability.

Further, in the above embodiment the timbre and tone volume are controlled through VCFs 12*a* to 12*d* and VCAs 13*a* to 13*d*. However, it is also possible to use digital filters or digital multipliers for the control of the timbre, tone volume, envelope, etc. Further, other processings may be applied to the waveform signal. Further, other systems than PCM may be employed as the modulation system for digitalizing the waveform signal.

Further, in the above embodiment the tone generation control unit 8 is provided with a plurality of waveform read/write channels constructed by a time division arrangement. However, it is also possible to provide a plurality of waveform read/write channels by using separate hardware of like circuit construction for each channel.

Further, only particular channels among a plurality of channels may be made exclusive write channels for only writing waveform signal in waveform memory 7, while the other channels are made exclusive read channels for only reading out waveform signal form waveform memory 7. The "waveform read/write channel" according to the invention means a channel which is capable of both read and write operations or only either read or write operation.

Further, in the above embodiment the tone number of the tone to be overdubbed is indicated by display elements 41a to 44*a* which are provided separately of display unit 48. However, it is possible to display such data on a single display unit.

Furthermore, while in the above embodiment only the tone volume is displayed, it is also possible to provide a display concerning a timbre, e.g., a filter cut-off frequency, which will be more convenient to the performer.

In summary, according to the invention it is possible to provide an overdubbing apparatus for an electronic musical instrument, which is convenient to use, has high operability and provides pleasant musical effects.

What is claimed is:

1. An electronic tone generation apparatus, for producing a modified waveform signal which corresponds to a modification of an external input sound signal, and for storing said modified waveform signal for future use in generating sounds, comprising:

external signal input means for receiving an external analog input signal;

sampling means coupled to said external signal input means for receiving said external analog input signal and for sampling said external analog input signal at a predetermined sampling frequency to produce a digital waveform signal;

waveform memory means coupled to said sampling means for storing said digital waveform signal provided form said sampling means;

signal modifying means coupled to said waveform memory means for reading out a digital waveform signal representing a waveform stored in the waveform memory means, and for modifying a timbre characteristic of said read-out digital waveform signal in a predetermined manner;

means for supplying a modified waveform signal, derived from the signal modifying means, to the waveform memory means to store, for a later performance, a digital signal representing said modified waveform signal in the waveform memory means; and reading means coupled to said waveform memory means for reading out, at said later performance, the digital signal representing said modified waveform signal;

said signal modifying means including filtering means for filtering the read-out digital waveform signal to change the timbre characteristic of the waveform represented by the digital waveform signal.

2. An electronic tone generation apparatus, in which an externally generated waveform signal is recorded in the form of a digital signal in a waveform memory means and the digital signal recorded in the waveform memory means is converted into a tone signal having a pitch, comprising:

external signal input means for receiving an external analog input signal;

means for converting said external analog input signal into a digital signal, and for storing said digital signal in said waveform memory means;

control means including a plurality of waveform read channels for reading digital signal stored in said waveform memory means to obtain a plurality of tones simultaneously;

signal modifying means coupled to said waveform memory means for reading out a digital signal representing a waveform stored in the waveform memory means, and for modifying a timbre characteristic of said read-out digital signal in a predetermined manner;

means for supplying a modified waveform signal, derived from the signal modifying means, to the waveform memory means to store, for a later performance, a digital signal representing said modified waveform signal in the waveform memory means; and reading means coupled to said waveform memory means for reading out, at said later performance, the digital signal representing said modified waveform signal;

said signal modifying mean including filtering means for filtering the read-out digital signal to change the timbre characteristic of the waveform represented by the digital signal.

3. An electronic tone generation apparatus, for producing a modified waveform signal which corresponds to a modification of an external input sound signal, and for storing said modified waveform signal for future use in generating sounds, comprising:

supplying means for supplying a digital waveform signal representing an original sound waveform;

waveform memory means coupled to said supplying means for storing said digital waveform signal supplied from said supplying means;

signal modifying means coupled to said waveform memory means for reading out a digital waveform signal representing a waveform stored in the waveform memory means, and for modifying at least one characteristic of said read-out digital waveform signal in a predetermined manner;

means for supplying a modified waveform signal, derived form the signal modifying means, to the waveform memory means to store, for a later performance, a digital signal representing said modified waveform in the waveform memory means; and reading means coupled to said waveform memory means for reading out, at said later performance, the digital signal representing said modified waveform signal.

4. The electronic tone generation apparatus according to claim 3 wherein said signal modifying means includes a filtering means for filtering the read-out digital waveform signal to change the timbre characteristic of the waveform represented by the digital waveform signal.

5. The electronic tone generation apparatus according to claim 4, wherein said filtering means includes a voltage controlled filter.

6. The electronic tone generation apparatus according to claim 3, wherein said modifying means includes a voltage controlled amplifier for controlling the characteristic of the read-out digital waveform signal.

7. An electronic tone generation apparatus, in which an original sound waveform signal is recorded in the form of a digital signal in a waveform memory means and the digital signal recorded in the waveform memory means is converted into a tone signal having a designated pitch, comprising:

supplying means for supplying a digital signal representing an original sound waveform;

means for storing said digital signal supplied from said supplying means in said waveform memory means;

control means including a plurality of waveform read channels for reading a digital signal stored in said waveform memory means at different rates to obtain a plurality of tones simultaneously;

signal modifying means coupled to said waveform memory means for reading out a digital signal representing the original sound waveform stored in the waveform memory means, and for modifying a timbre characteristic of said read-out digital signal in a predetermined manner;

means for supplying a modified waveform signal, derived from the signal modifying means, to the waveform memory means to store, for a later performance, a digital signal representing said modified waveform signal in the waveform memory means; and reading means coupled to said waveform memory means for reading out, at said later performance, the digital signal representing said modified waveform signal.

8. The electronic tone generation apparatus according to claim 7, wherein said signal modifying means includes a filtering means for filtering the read-out digital signal to change the timbre characteristic of the waveform represented by the digital signal.

9. The electronic tone generation apparatus according to claim 8, wherein said filtering means includes a voltage controlled filter.

10. The electronic tone generation apparatus according to claim 7, wherein said modifying means includes a voltage controlled amplifier for controlling the characteristic of the read-out digital signal.

* * * * *